US010258115B2

(12) United States Patent
Novak

(10) Patent No.: US 10,258,115 B2
(45) Date of Patent: Apr. 16, 2019

(54) WATCH STRAPS

(71) Applicant: Smart Strappers LLC, Spring Park, MN (US)

(72) Inventor: Jason Novak, Chicago, IL (US)

(73) Assignee: Smart Strappers LLC, Spring Park, MN (US)

( * ) Notice: Subject to any disclaimer, the term of this patent is extended or adjusted under 35 U.S.C. 154(b) by 225 days.

(21) Appl. No.: 15/371,755

(22) Filed: Dec. 7, 2016

(65) Prior Publication Data

US 2017/0181510 A1 Jun. 29, 2017

Related U.S. Application Data

(60) Provisional application No. 62/272,450, filed on Dec. 29, 2015.

(51) Int. Cl.

| | |
|---|---|
| ***A44C 5/14*** | (2006.01) |
| ***A44C 5/20*** | (2006.01) |
| ***A44C 5/18*** | (2006.01) |
| ***A44C 15/00*** | (2006.01) |
| *A44C 5/00* | (2006.01) |

(52) U.S. Cl.

CPC ..... *A44C 5/147* (2013.01); *A44C 5/185* (2013.01); *A44C 5/2071* (2013.01); *A44C 15/0025* (2013.01); *A44C 5/0053* (2013.01); *A44C 5/2085* (2013.01); *A44D 2201/50* (2013.01)

(58) Field of Classification Search

CPC ..... A44C 5/14; A44C 5/147; G04B 37/1486; Y10T 24/4718; Y10T 24/4782

USPC ..... 224/167, 168, 175, 176, 177; 368/281, 368/282

See application file for complete search history.

(56) References Cited

U.S. PATENT DOCUMENTS

| | | | | |
|---|---|---|---|---|
| 3,073,492 | A * | 1/1963 | Berger | A44C 5/14 224/167 |
| 4,597,138 | A * | 7/1986 | Hirsch | A44C 5/14 24/265 B |
| 5,065,376 | A | 11/1991 | Choulat | |
| 5,631,879 | A | 5/1997 | Pequignet | |
| 7,703,974 | B2 | 4/2010 | Bouille | |
| 2009/0173760 | A1 | 7/2009 | Good | |
| 2010/0243688 | A1 | 9/2010 | Gutierrez et al. | |
| 2014/0083133 | A1 | 3/2014 | Lee et al. | |

OTHER PUBLICATIONS

Amazon.com "*Life Trak Band*," located at http://www.amazon.com/LifeTrak-LTKSS005-Parent-Life-Trak-Band/dp/BOOGZHSUMM (Jan. 5, 2016).

Mashable, "*12 Unique Apple Watch Bands We Want on Our Wrists*," located at http://mashable.com/2014/09/11/apple-watch-bands/#JFzn6Y39GGqE (Jan. 5, 2016).

* cited by examiner

*Primary Examiner* — Abigail E Troy

(74) *Attorney, Agent, or Firm* — Leydig, Voit & Mayer, Ltd.

(57) ABSTRACT

A set of watch straps include a first strap, the first strap including a first band, a first adapter, and a first lug connected in series, and a second strap, the second strap including a second band, a second adapter, and a second lug connected in series. The first lug is configured to slide into a first strap receiving groove of the watch, and the second lug is configured to slide into a second strap receiving groove of the watch. At least one of the first strap and the second strap is reversible.

20 Claims, 14 Drawing Sheets

WATCH STRAPS

CROSS-REFERENCE TO RELATED APPLICATIONS

The instant patent application claims the benefit of U.S. Provisional Application Ser. No. 62/272,450, which was filed on Dec. 29, 2015, and which is incorporated herein in its entirety by reference.

TECHNICAL FIELD

This patent disclosure relates generally to reversible watch straps and, more particularly, to a reversible watch strap.

BACKGROUND

Straps for wrist watches may be made from several materials including leather, metal, cloth and the like. Straps can be formed as a single piece that is connected on both ends to the watch, or they may alternatively be formed in two pieces, that are connected one each on either side of the watch. Regardless of configuration, the strap or straps include an attachment mechanism that secures the watch on the arm of the user. Although watch straps have utility, they are also sometimes selected to match the style of the user.

In a typical configuration, an end of the watch strap that is connected to the watch includes a bore or a loop through which a spring-loaded pin is inserted. The pin pivotally connects the end of the strap to a bezel of the watch by engaging corresponding openings formed in the bezel. To insert and also to remove the pin, the user must compress the spring-loaded action to disengage the pens from their respective bores and thus remove the pin from the bezel. This process may be repeated in reverse to install the strap onto the watch.

BRIEF SUMMARY

The disclosure describes a set of reversible watch straps for use with a wristwatch, including but not limited to so-called smart-watches such as the Apple Watch. The set of watch straps includes a first strap and a second strap. The first strap includes a first band, a first adapter, and a first lug. The band is connected to the adapter such that it can rotate and present either of its two faces outwardly with respect to the wrist of the wearer. The adapter is connected to the lug, which lug mounts to the watch. As can be appreciated, different lugs can be used to interface with different watch mounting features and elements. The second strap includes a second band, a second adapter, and a second lug connected in series. Like the first strap, the second strap is reversibly engaged with the second adapter, which is in turn configured to engage the second lug that mounts on an opposite side of the watch body than the first lug. In the illustrated, exemplary embodiment, the interface between each of the two lugs and the body of the watch includes a channel into which each lug slides and locks. As shown in the various illustrations, the first lug is configured to slide into a first strap receiving groove of the watch, and the second lug is configured to slide into a second strap receiving groove of the watch.

In one aspect, therefore, the disclosure describes a set of watch straps. The set of watch straps includes a first strap that includes a first band, a first adapter, and a first lug connected in series, wherein the first lug is configured to releasably engage a first strap receiving groove on one side of a watch bezel, and a second strap, the second strap including a second band, a second adapter, and a second lug connected in series, wherein the second lug is configured to slide into a second strap receiving groove on a second side of the watch bezel. The set further includes an adjustably securable mechanism for releasably and adjustably coupling a free end of the second strap with a location along the first strap. The first adapter is releasably and reversibly connectable with the first lug, while the first lug is connected on the one side of the watch bezel, and the second adapter is releasably and reversibly connectable with the second lug, while the second lug is connected on the second side of the watch bezel. The first strap and the second strap are orientable selectively with respect to the watch bezel depending on an orientation of connection between the first adapter with the first lug in the second adapter with the second lug without removing the first lug and the second lug from the watch bezel.

In another aspect, the disclosure describes a method for reversibly attaching a set of watch straps to a watch bezel. The method includes connecting a first strap to one side of a watch bezel, the first strap including a first band, a first adapter, and a first lug connected in series, wherein the first lug is configured to releasably engage a first strap receiving groove on the one side of the watch bezel. The method further includes connecting a second strap to a second side of the watch bezel, the second strap including a second band, a second adapter, and a second lug connected in series, wherein the second lug is configured to slide into a second strap receiving groove on a second side of the watch bezel. The method also includes adjustably and releasably coupling a free end of the second strap with a location along the first strap, reversing the first band and the first adapter relative to the first lug, and reversing the second band and the second adapter relative to the second lug, by releasing the coupling between the first and second bands, releasing a connection between the first adapter and the first lug while the first lug remains connected with the watch bezel, reversing an orientation of the first band and the first adapter relative to the first lug, reconnecting the first adapter with the first lug in an opposite orientation, releasing a connection between the second adapter and the second lug while the second lug remains connected with the watch bezel, reversing an orientation of the second band and the second adapter relative to the second lug, reconnecting the second adapter with the second lug in an opposite orientation, and re-coupling the first strap with the second strap.

DETAILED DESCRIPTION

Figure 1:
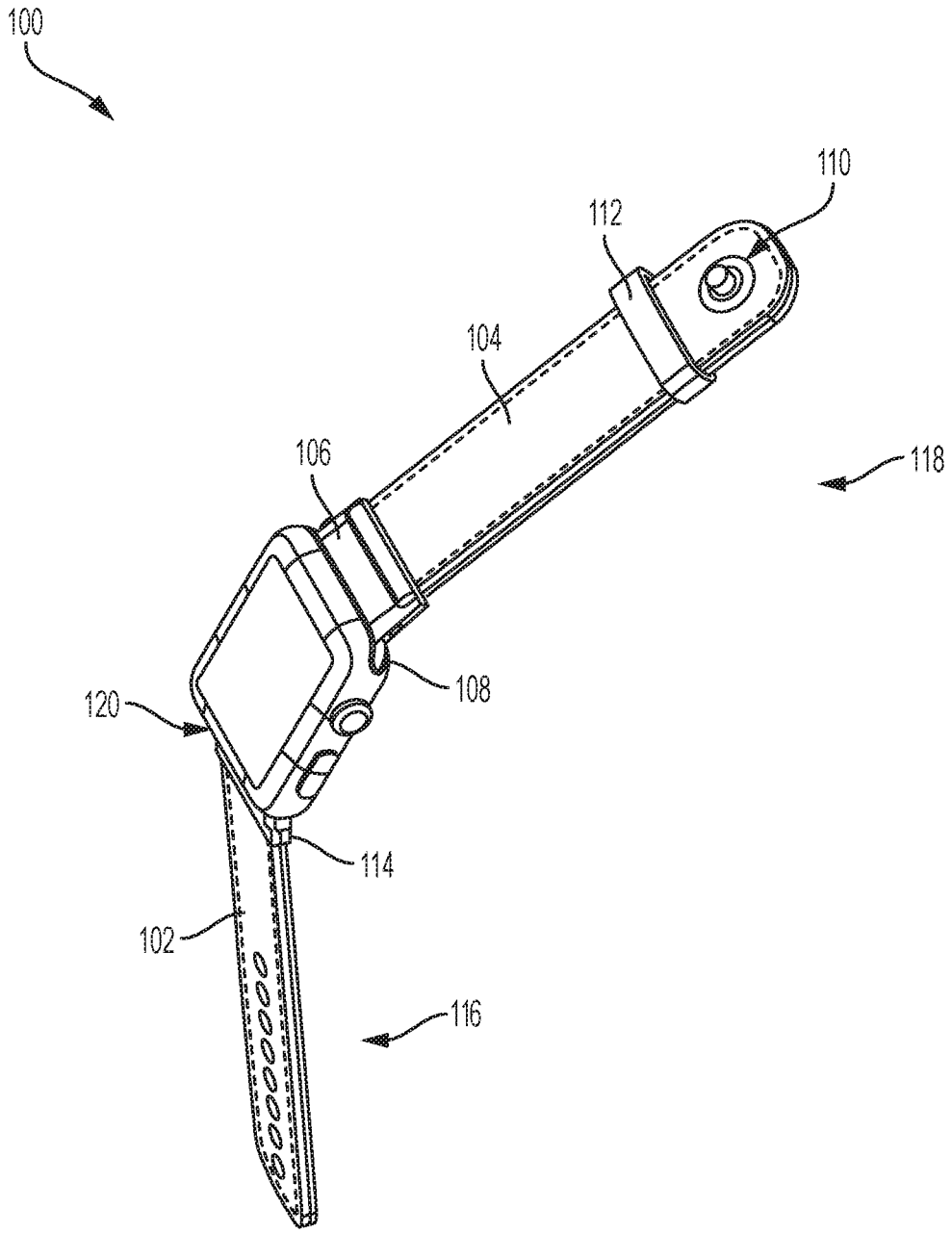
FIG. 1 is a perspective view of a set of reversible watch straps in accordance with the disclosure.
Figure 2:
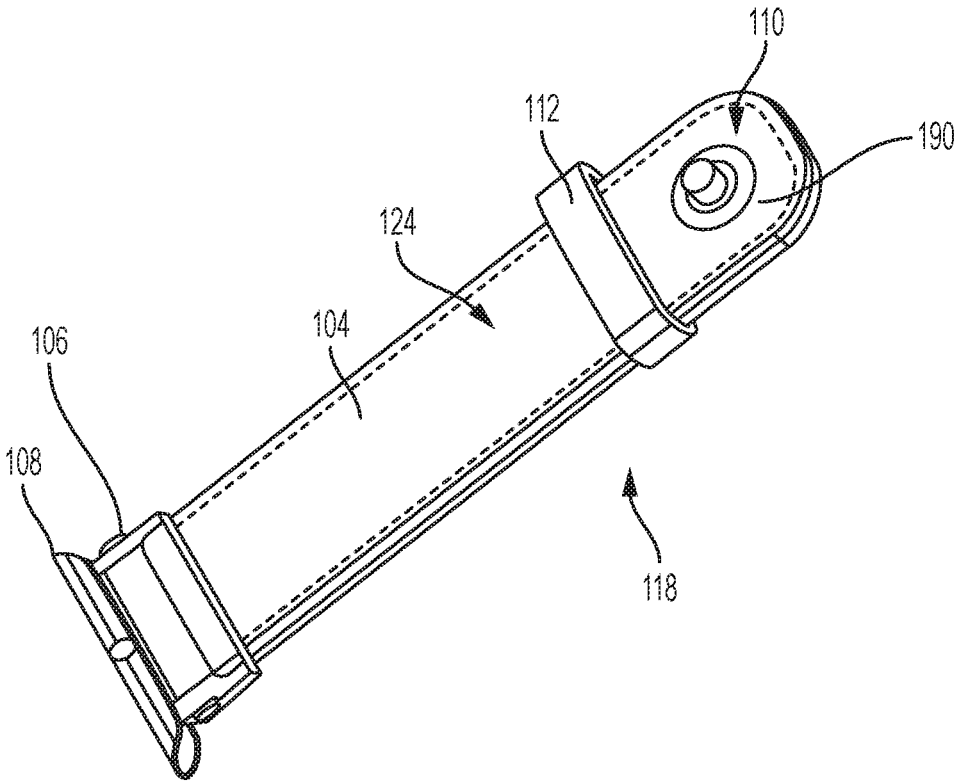
FIG. 2 is a perspective view of a second watch strap in accordance with the disclosure.

FIG. 1 shows a set of reversible watch bands or straps 100 for use with a watch, which shown in a perspective view, in accordance with the disclosure. The set of reversible watch straps 100 includes a first strap 116 and a second strap 118. The first strap 116 includes a first band 102, a first adapter 114, and a first lug 120. The first band 102 is connected to the first adapter 114, and the first adapter 114 is connected to the first lug 120. Similarly, and in reference to FIG. 2, the second strap 118 includes a second band 104, a second adapter 106, and a second lug 108. As with the first band 102, the second band 104 is connected to the second adapter 106, which is in turn connected to the second lug 108. The first and second lugs 120 and 108 are connected to the watch body. The second strap 118 may further include a free loop 112 disposed about the second band 104. The second band 104 includes a clasp hole 190, the clasp hole 190 configured to house a clasp 110. In the illustrated embodiment, the first lug 120 and the second lug 108 are both configured to slidably attach to an Apple Watch. The first lug 120 is substantially similar to the second lug 108, and the first adapter 114 is substantially similar to the second adapter 106 such that the first adapter can be substituted for the second adapter, and the first lug can be substituted for the second lug such that a user can wear the watch on either the right or the left wrist.

Figure 3:
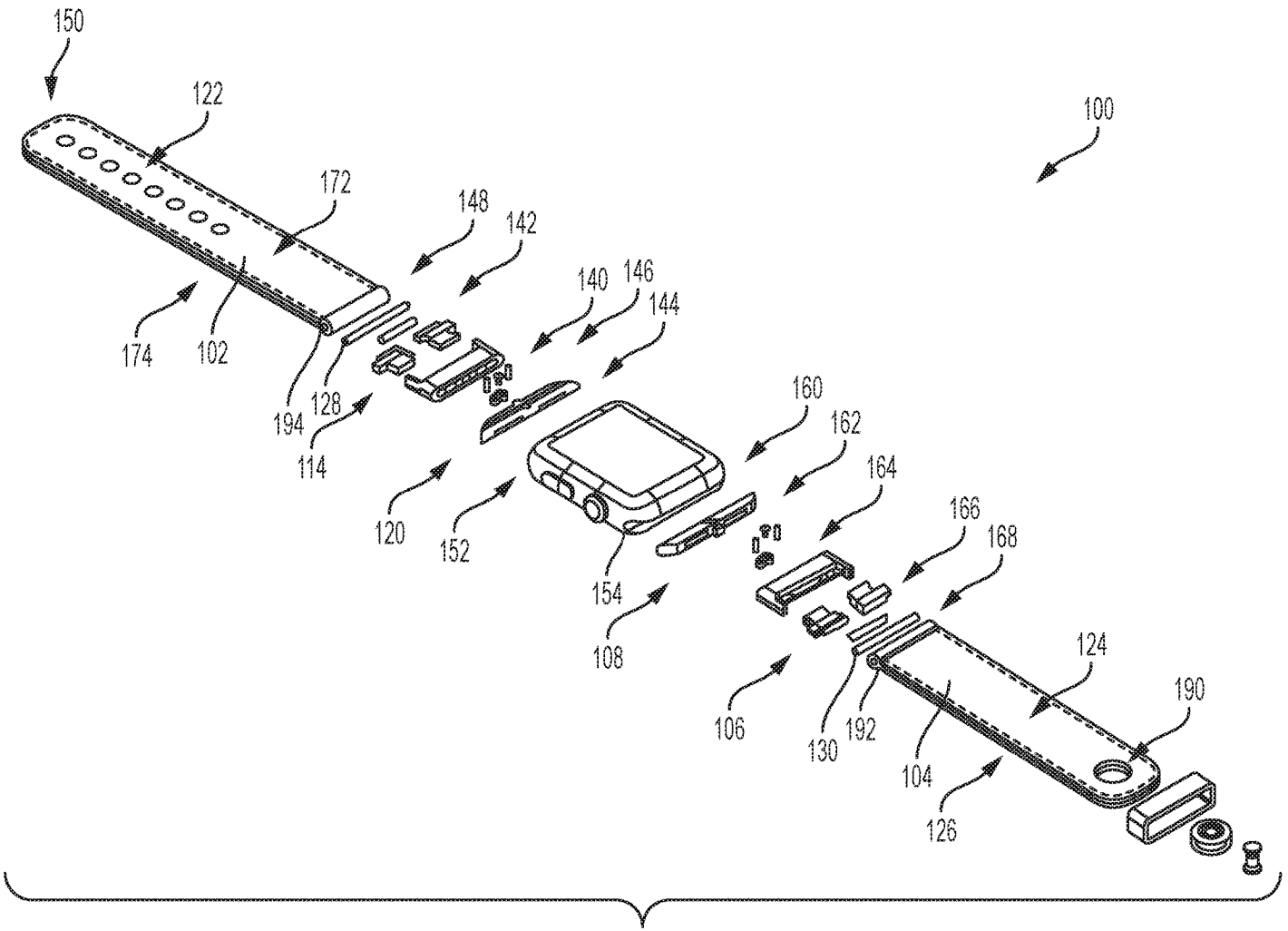
FIG. 3 is an exploded view a set of reversible watch straps in accordance with the disclosure.

FIG. 3 shows an exploded view of the set of reversible watch straps 100. The first adapter 114 has a first end 142 and a second end 140, the first end 142 connecting to a first end 148 of the first band 102 and the second end 140 connecting to a first end 146 of the first lug 120. The second end 144 of the first lug 120 is shaped to correspond with a curvature of a first strap receiving groove 152 of the watch. The first band 102 includes a first face 172 and a second face 174. The second face 174 may be of a different color, texture, or material than the first face 172. The first band 102 forms a plurality of adjustment holes 122 extending from near a second end 150 of the first band 102 and towards the first end 148 of the first band 102. An end of the clasp can be inserted and engaged with one of the plurality of adjustment holes 122 when a user is wearing the watch. The first band 102 connects with the first adapter 114, for example, via a spring bar 128 disposed within a loop 194 near the first end 148 of the first band 102.

The second adapter 106 has a first end 166 and a second end 164, the first end 166 connecting to a first end 168 of the second band 104 and the second end 164 connecting to a first end 162 of the second lug 108. The second end 160 of the second lug 108 is shaped to correspond with a curvature of a second strap receiving groove 154 of the watch. The second band 104 includes a first face 124 and a second face 126. The second face 126 may be of a different color, texture, or material than the first face 124. The second band 104 connects with the second adapter 106, for example, via a spring bar 130 disposed within a loop 192 near the first end 168 of the second band 104.

Figure 4:
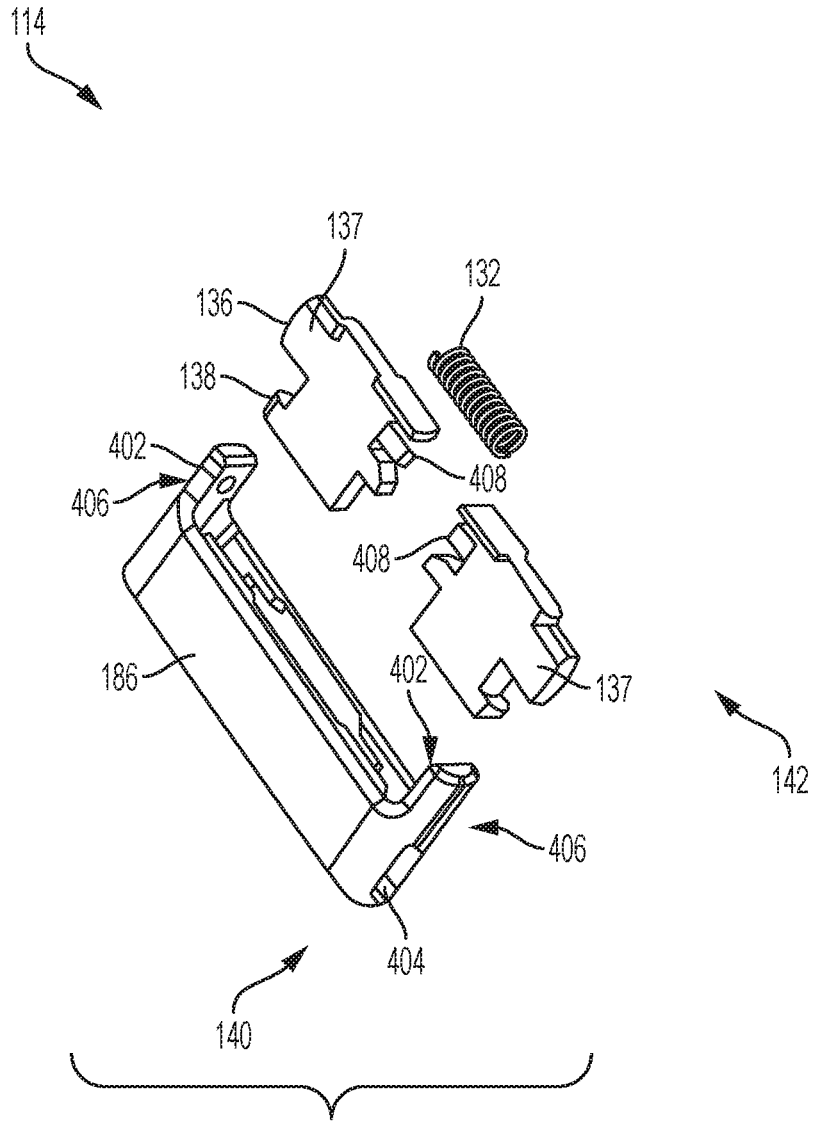
FIG. 4 is an exploded view of an adapter in accordance with the disclosure.

FIG. 4 shows an exploded view of an example of the first adapter 114. The first adapter 114 includes a casing 186, a set of tabs 136, and a spring 132, the spring 132 is slidably disposed relative to a cylindrical rod 408 on each tab 136, and is further interposed between the set of tabs 136. The casing 186 forms a slot 404 on two sides of the first adapter 114. The casing 186 forms a set of arms 406 extending from adjacent each slot 404 and towards the first end 142 of the first adapter 114. Each arm of the set of arms 406 forms a hole 402, the hole 402 configured to house a pin, such as the spring bar 128. Each tab of the set of tabs 136 forms a squeeze nub 137 and a lock nub 138. The set of tabs 136 is disposed substantially within the casing 186 with the squeeze nubs 137 extending outside the casing 186 through the slots 404 and the lock nubs 138 extending outside the casing 186 at the second end 140 of the first adapter 114.

Figure 5:
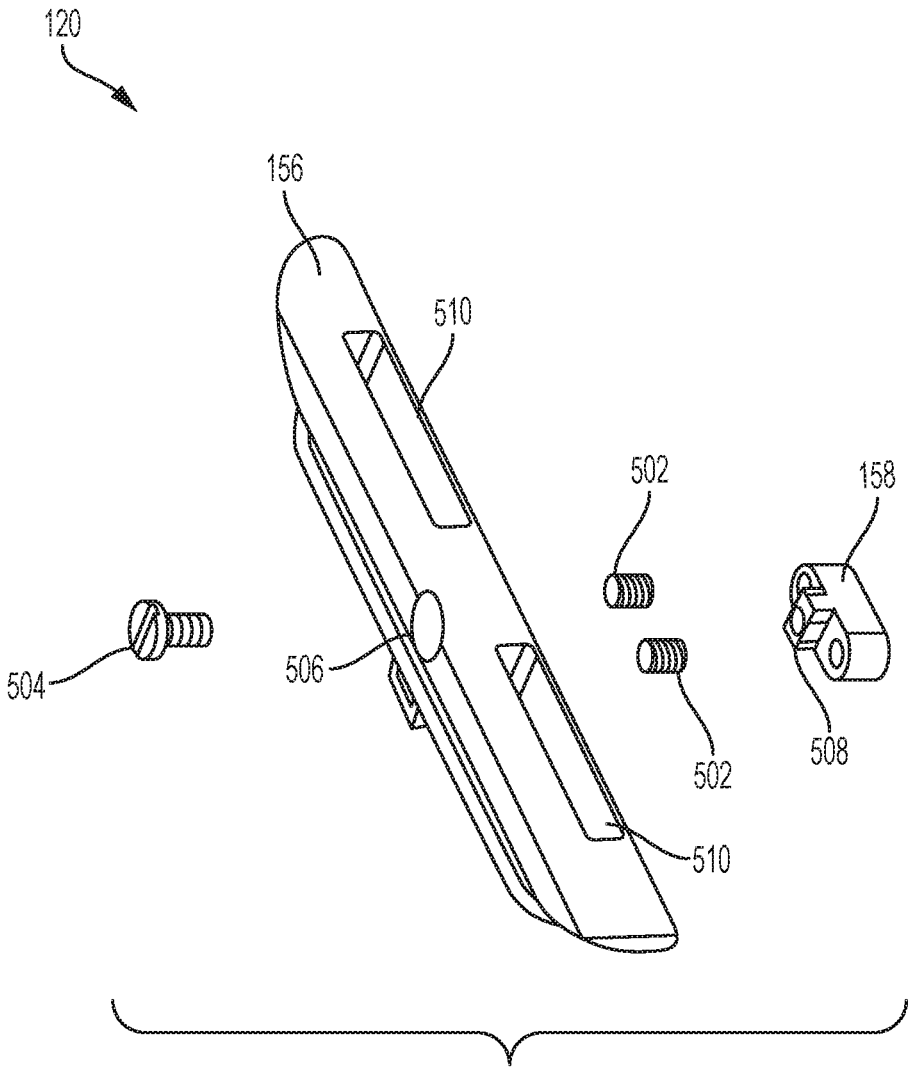
FIG. 5 is an exploded view of a lug in accordance with the disclosure.

As shown in FIG. 5, the first lug 120 includes a lug body 156 and a button 158, the button 158 protruding from an outside bottom surface of the lug body 156. The button 158 is shaped to engageably mate with a detent formed within the first strap receiving groove 152. The button 158 is fastened to the lug body 156 by a fastener such as a screw 504. The screw 504 passes through an opening 506 of the lug body 156 and threadably engages a threaded opening 508 formed in the button 158. A set of springs 502 is interposed between the button 158 and the lug body 156 such that the button 158 recedes into the lug body 156 when pressed. The lug body 156 forms a set of cavities 510 adjacent the first end 146 of the first lug 120 and extends to the second end 144 of the first lug 120. Each of the set of cavities 510 corresponds in size, shape and position with the lock nubs 138 of the first adapter 114.

In an engaged condition such as a condition when a user is wearing a watch, the first lug 120 is slid into the first strap receiving groove 152 and the button 158 protrudes into a detent of the first strap receiving groove 152, preventing the first strap 116 from sliding in either direction without an external force. In operation, to remove the first strap 116 from the watch, the first lug 120 is slid out of the first strap receiving groove 152 with an external force.

In operation, the first band 102 and the first adapter 114 are configured to be connected to the first lug 120 by pressing the squeeze nubs 137 together such that the lock nubs 138 enter the cavities 510 of the lug. A subsequent release of the squeeze nubs 137 causes the lock nubs 138 to move away from each other and catch the first lug 120, locking the first adapter 114 to the first lug 120. In operation, the first band 102 and the first adapter 114 are configured to be disconnected from the first lug 120 by pressing the squeeze nubs 137 together such that the lock nubs 138 are able to exit the cavities 510. The force that keeps the squeeze nubs 137 apart is provided by the spring.

The second band 104, the second adapter 106, and the second lug 108 connect in substantially the same fashion as the first band 102, the first adapter 114, and the first lug 120. In operation, the first band 102 and the second band 104 are both configured to be reversible such that either face 124, 126, 172, 174 of either the first band 102 or the second band 104 may face outwardly.

Figure 6:
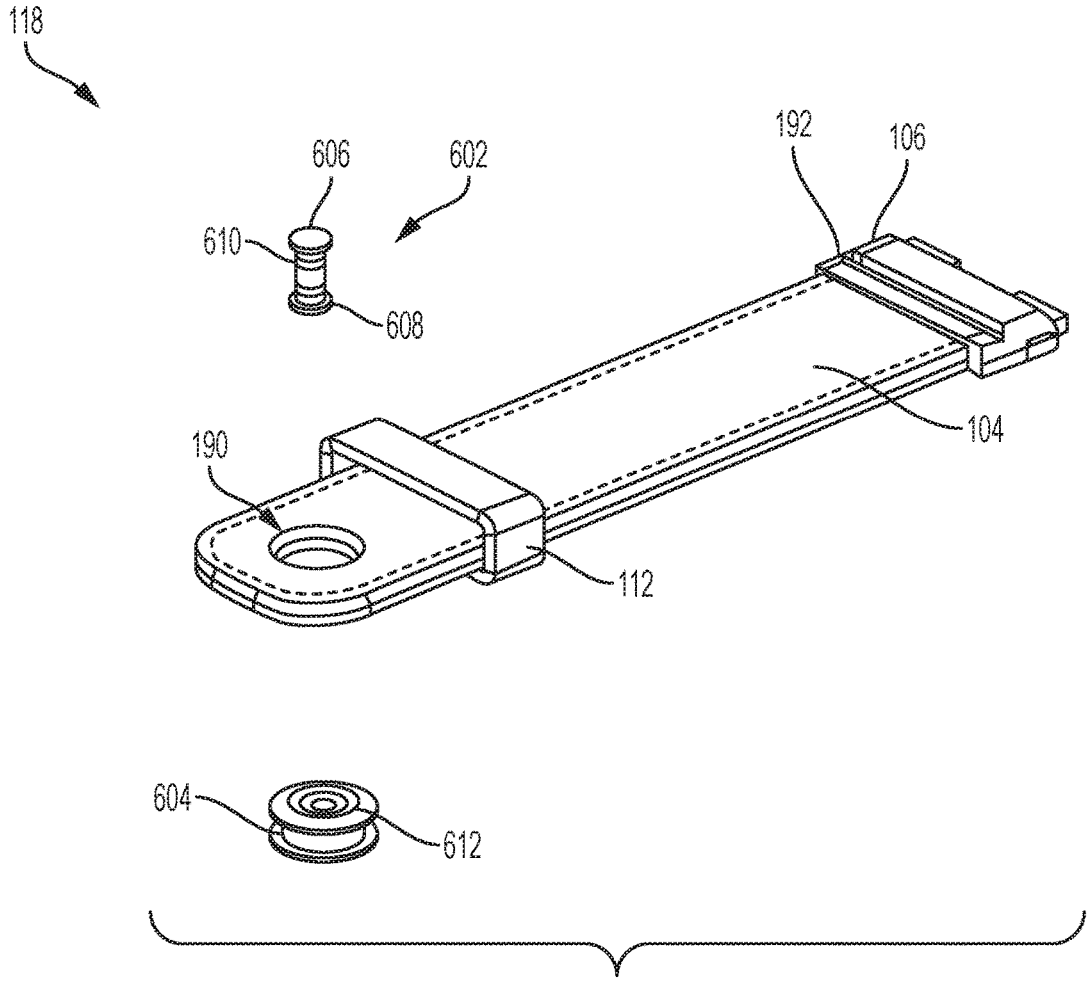
FIG. 6 is an exploded view of a clasp in accordance with the disclosure.
Figure 7:
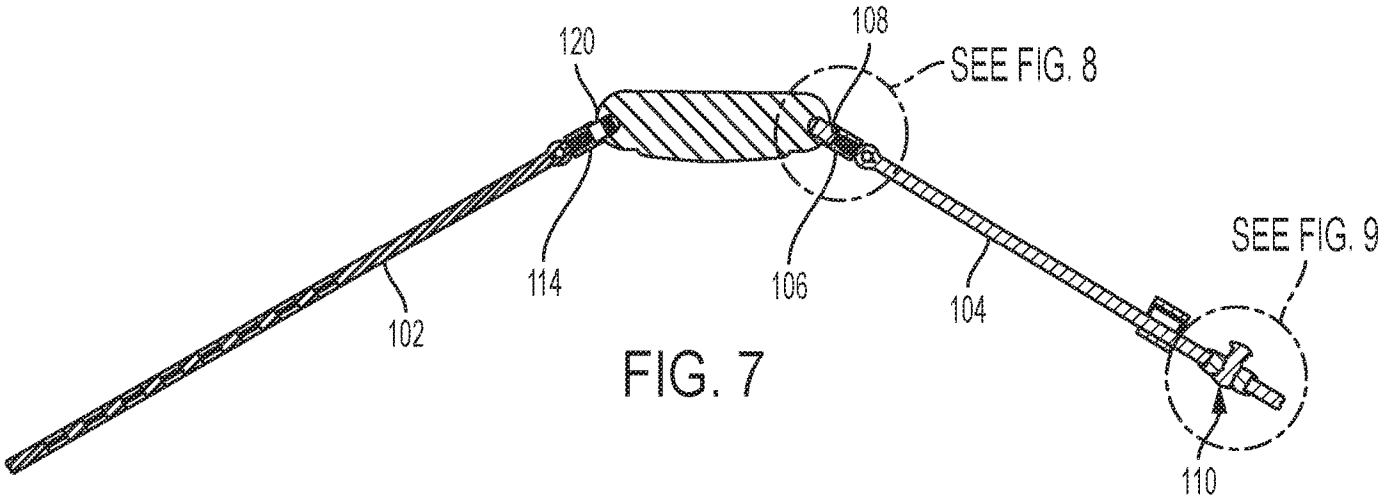
FIG. 7 is a section view of a set of reversible watch straps in accordance with the disclosure.

As shown in FIG. 6, the second band 104 forms a clasp hole 190. The clasp 110 includes a clasp body 602 and a clasp housing 604, wherein the clasp housing 604 is disposed within the clasp hole 190. The clasp housing 604 forms an opening 612 concentrically with respect to the clasp hole 190. The clasp body 602 forms a middle portion 610 that is generally cylindrical in shape with a first clasp head 606 disposed at one end and a second clasp head 608 disposed at another end. A diameter of the first clasp head 606 and a diameter of the second clasp head 608 are both greater than a diameter of the middle portion 610.

Figure 9:
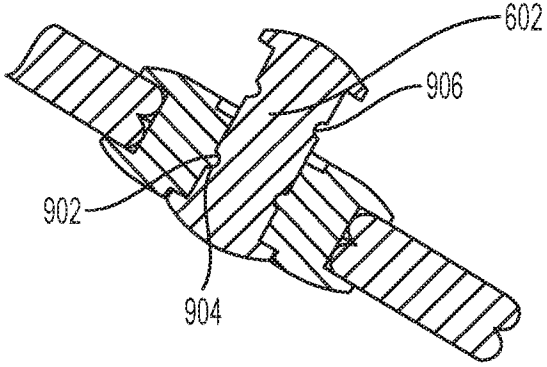
FIG. 9 is a section view of a clasp in accordance with the disclosure.
Figure 8:
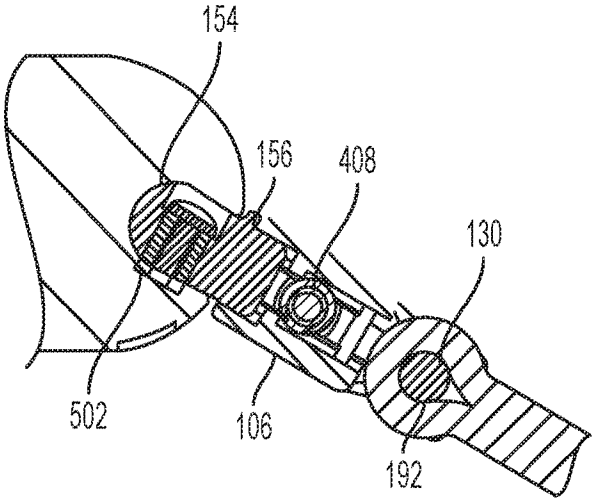
FIG. 8 is a section view of a band, an adapter, and a lug connected in series in accordance with the disclosure.
Figure 10:
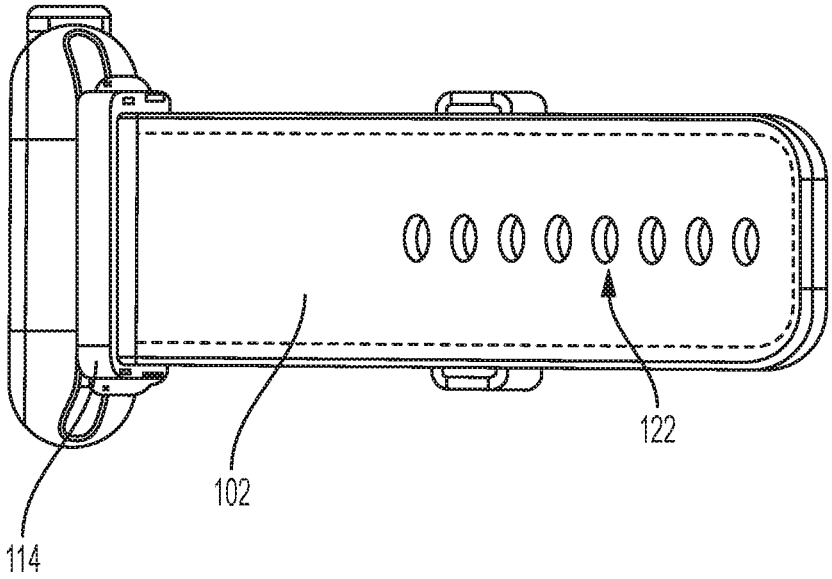
FIG. 10 is a front view of a set of reversible watch straps in accordance with the disclosure.
Figure 11:
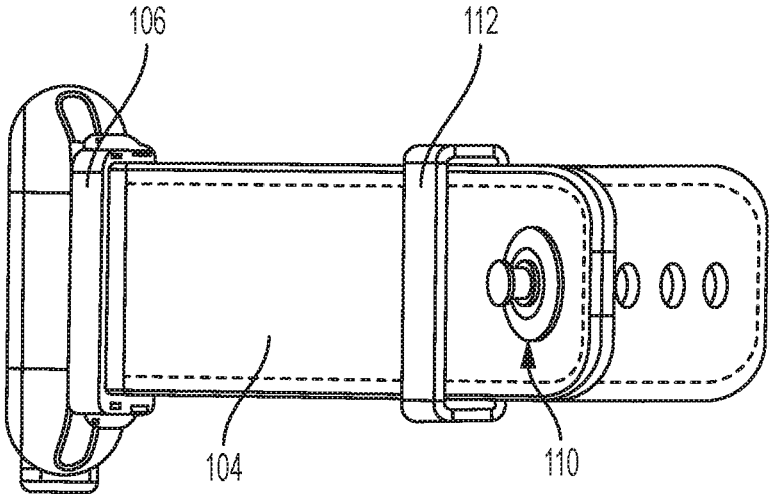
FIG. 11 is a rear view of a set of reversible watch straps in accordance with the disclosure.
Figure 12:
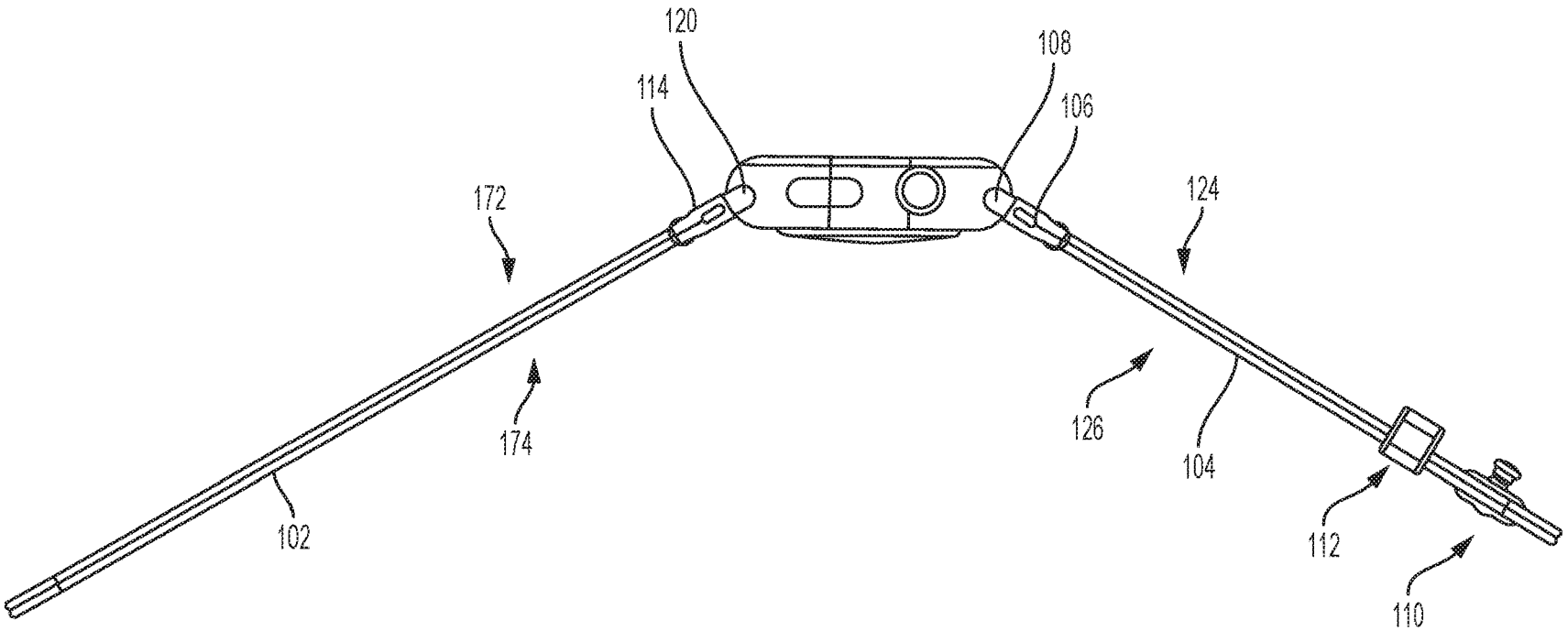
FIG. 12 is a right side view of a set of reversible watch straps in accordance with the disclosure.
Figure 13:
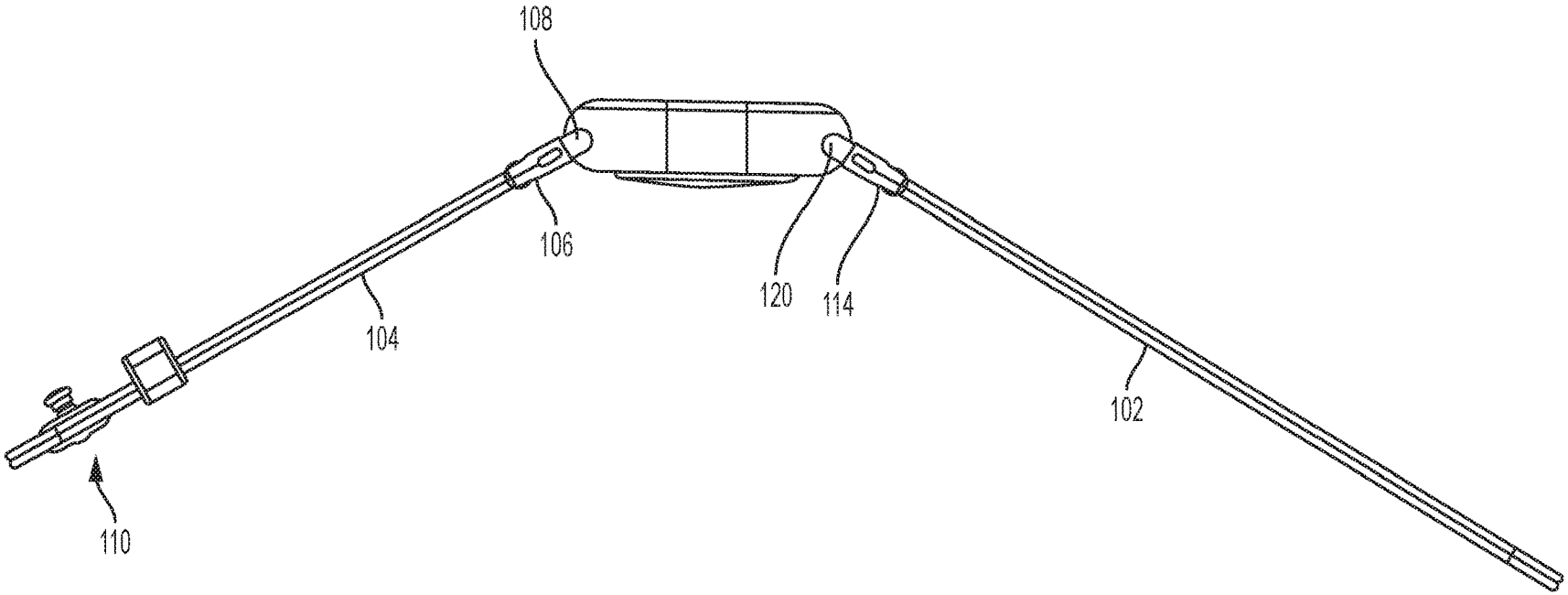
FIG. 13 is a left side view of a set of reversible watch straps in accordance with the disclosure.
Figure 14:
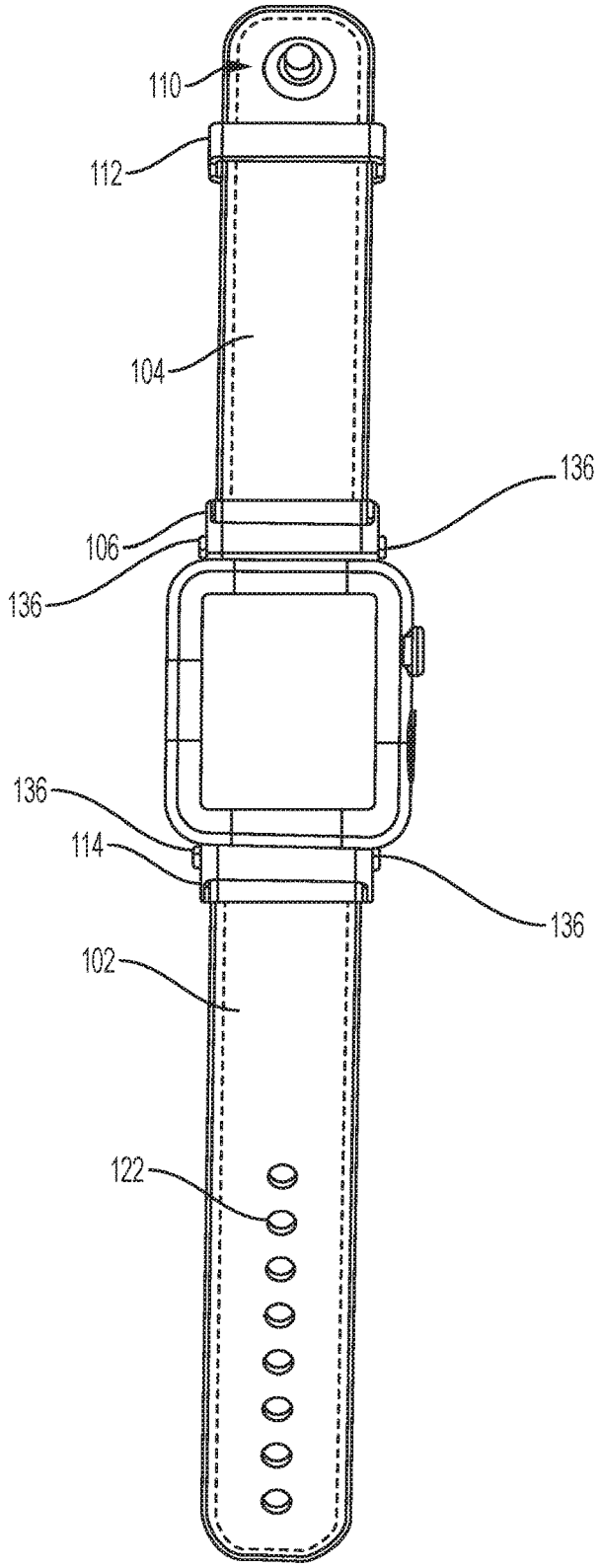
FIG. 14 is a top view of a set of reversible watch straps in accordance with the disclosure.
Figure 15:
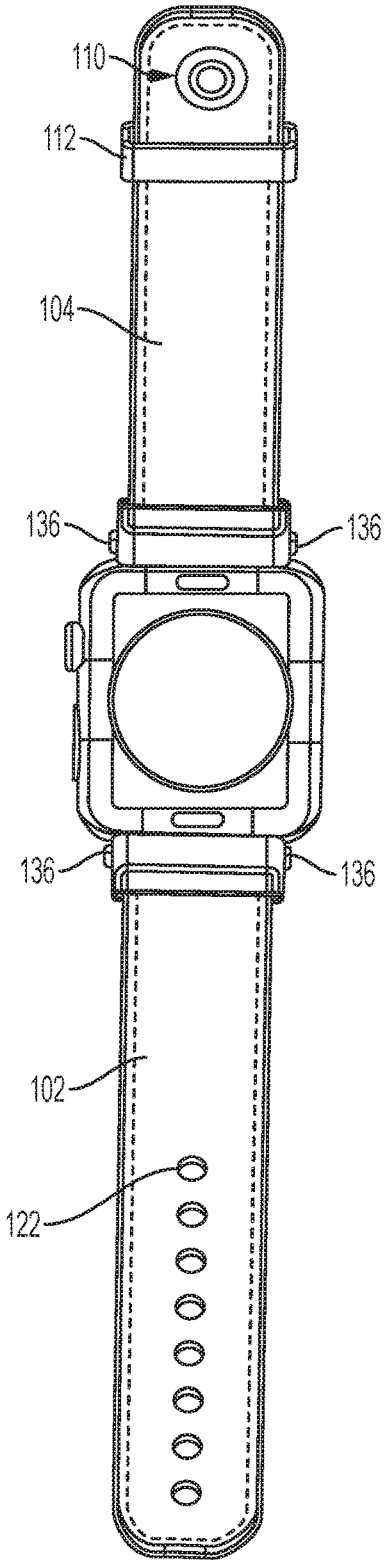
FIG. 15 is a bottom view of a set of reversible watch straps in accordance with the disclosure.
Figure 16:
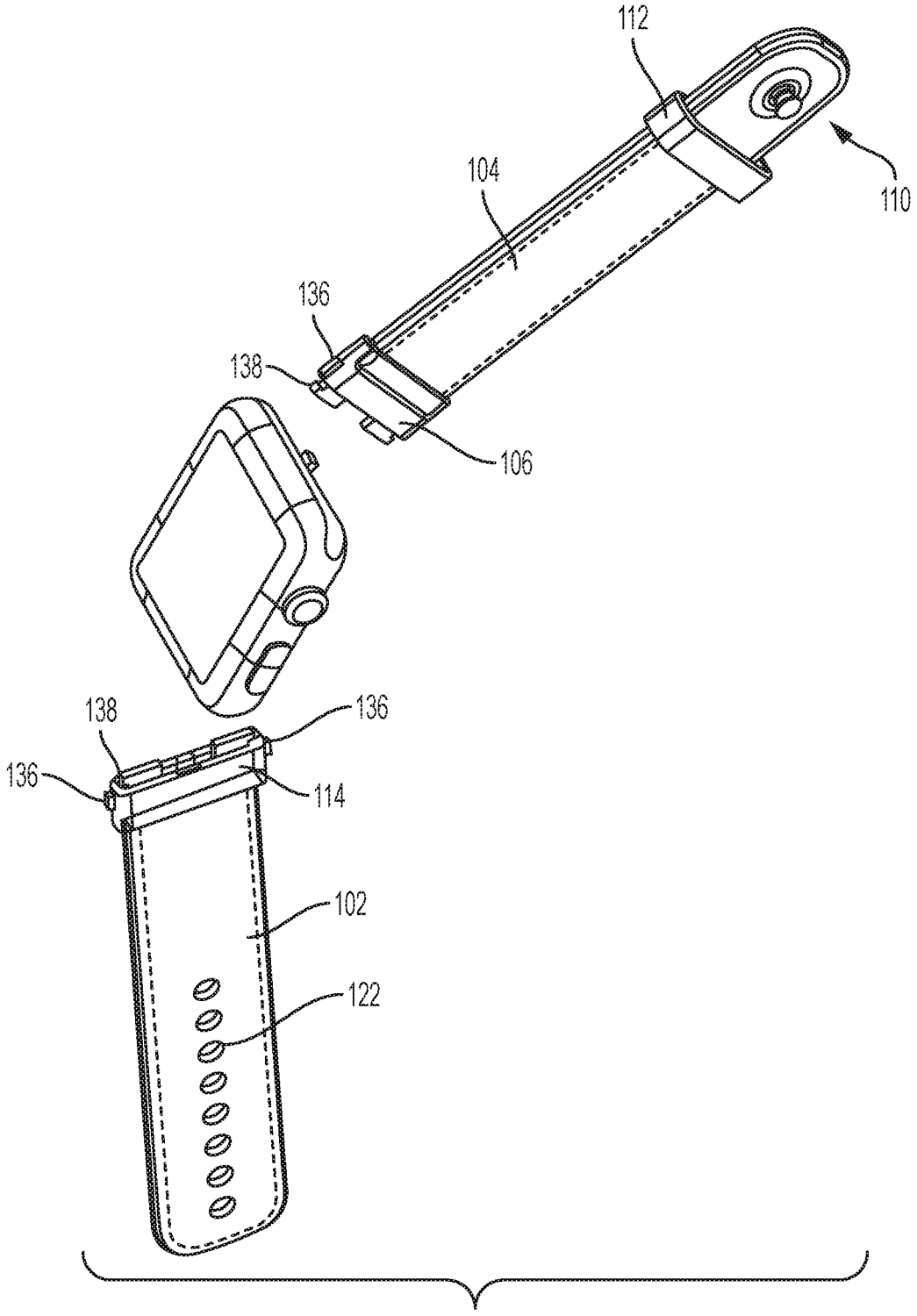
FIG. 16 is a rotated view of a set of reversible watch straps in accordance with the disclosure.

In the section view shown in FIG. 9, the clasp housing 604 forms a protruding ring 902 adjacent an interior surface formed by the opening 612 and extending inwards towards a center of the opening 612. The clasp body 602 further forms a first groove 904 and a second groove 906. The protruding ring 902 of the clasp housing 604 is configured to fit into the first groove 904 of the clasp body 602 when the clasp 110 is in a first position. The protruding ring 902 of the clasp housing 604 is configured to fit into the second groove 906 of the clasp body 602 when the clasp 110 is in a second position. The first and second clasp heads 606, 608 are configured to pass through any of the adjustment holes 122 of the first band 102 to attach the second band 104 to the first band 102. The clasp 110 extends outwardly substantially perpendicular from both the first face 124 and the second face 126 of the second band 104, when the faces are flat. This orientation allows either face 124, 126 of the second band 104 to face outwardly when the second band 104 attaches to the first band 102.

In another aspect, the method under consideration relates to reversing a set of watch bands. The first band and the first adapter are configured to be disconnected from the first lug by pressing the squeeze nubs of the first adapter towards each other such that the lock nubs of the first adapter are able to release from the cavities of the first lug. The first band is reversed so that a side of the first band that was facing outwardly now faces inwardly. The reversed band is then attached to the first lug by pressing the squeeze nubs of the first adapter towards each such that the lock nubs of the first adapter enter the cavities of the first lug. The squeeze nubs are released to prevent the lock nubs from exiting the cavities of the first lug, thus fixing the first band to the first lug. The second band is released from the second lug, reversed, and re-connected to the second lug. The clasp is adjusted from either a first position to a second position or a second position to a first position.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A set of watch straps, comprising:

a first strap, the first strap including a first band, a first adapter, and a first lug connected in series, wherein the first lug is configured to releasably engage a first strap receiving groove on one side of a watch bezel;

a second strap, the second strap including a second band, a second adapter, and a second lug connected in series, wherein the second lug is configured to slide into a second strap receiving groove on a second side of the watch bezel; and an adjustably securable mechanism for releasably and adjustably coupling a free end of the second strap with a location along the first strap;

wherein the first adapter is releasably and reversibly connectable with the first lug, while the first lug is connected on the one side of the watch bezel, and wherein the second adapter is releasably and reversibly connectable with the second lug, while the second lug is connected on the second side of the watch bezel, such that the first strap and the second strap are orientable selectively with respect to the watch bezel depending on an orientation of connection between the first adapter with the first lug and the second adapter with the second lug without removing the first lug and the second lug from the watch bezel.

2. The set of watch straps as recited in claim 1, wherein the first adapter and the second adapter are of identical construction.

3. The set of watch straps as recited in claim 1, wherein the first lug and the second lug are of identical construction.

4. The set of watch straps as recited in claim 1, wherein the adjustable securable mechanism includes a clasp hole formed in the second band and configured to house a clasp.

5. The set of watch straps as recited in claim 4, wherein the clasp is disposed in a clasp housing that is connected to the second strap and slidably retains the clasp, and wherein the clasp is configured to protrude selectively on one side or another side of the second band by sliding relative to the clasp housing.

6. The set of watch straps as recited in claim 5, wherein the clasp housing forms an opening concentrically with respect to the clasp hole, and wherein the clasp is slidably disposed within the clasp hole.

7. The set of watch straps as recited in claim 6, wherein the clasp includes a body including a generally cylindrical middle portion with a clasp head disposed on either end.

8. The set of watch straps as recited in claim 7, wherein the first strap includes a plurality of aligned openings configured to releasably engage the clasp.

9. The set of watch straps as recited in claim 1, wherein the first adapter includes a casing, a set of tabs slidably mounted in the casing in an opposed orientation, and a spring disposed between the set of tabs such that the spring provides a force tending to push the tabs apart.

10. The set of watch straps as recited in claim 9, wherein each of the set of tabs includes an arm that matingly engages a corresponding slot in the first lug when the first lug is connected with the first adapter.

11. The set of straps as recited in claim 9, wherein each of the set of tabs includes a squeeze knob protruding from the casing and being configured such that a user depressing both squeeze knobs simultaneously causes engagement between the first lug and the first adapter to be released.

12. A method for reversibly attaching a set of watch straps to a watch bezel, comprising:

connecting a first strap to one side of the watch bezel, the first strap including a first band, a first adapter, and a first lug connected in series, wherein the first lug is configured to releasably engage a first strap receiving groove on the one side of the watch bezel;

connecting a second strap to a second side of the watch bezel, the second strap including a second band, a second adapter, and a second lug connected in series, wherein the second lug is configured to slide into a second strap receiving groove on the second side of the watch bezel;

adjustably and releasably coupling a free end of the second strap with a location along the first strap; and reversing the first band and the first adapter relative to the first lug, and reversing the second band and the second adapter relative to the second lug, by:

releasing the coupling between the first and second bands, releasing a connection between the first adapter and the first lug while the first lug remains connected with the watch bezel;

reversing an orientation of the first band and the first adapter relative to the first lug, reconnecting the first adapter with the first lug in an opposite orientation, releasing a connection between the second adapter and the second lug while the second lug remains connected with the watch bezel;

reversing an orientation of the second band and the second adapter relative to the second lug, reconnecting the second adapter with the second lug in an opposite orientation, and re-coupling the first strap with the second strap.

13. The method of claim 12, wherein the first adapter and the second adapter are interchangeable.

14. The method of claim 12, wherein the first lug and the second lug are interchangeable.

15. The method of claim 12, wherein coupling the first strap with the second strap includes mounting a clasp in a clasp hole formed in the second strap, and engaging a clasp opening with the clasp.

16. The method of claim 15, wherein the clasp is reversibly mounted on the second strap.

17. The method of claim 12, wherein the first adapter includes a casing that slidably accepts and mounts therein a set of tabs mounted in an opposed orientation.

18. The method of claim 17, further comprising using a spring disposed between the set of tabs to provide a force tending to push the tabs apart.

19. The method of claim 18, further comprising providing an arm in each set of tabs that matingly engages a corresponding slot in the first lug when the first lug is connected with the first adapter.

20. The method of claim 17, wherein releasing an engagement between the fist adapter and the first lug or the second adapter and the second lug includes squeezing a set of knobs protruding from the casing and connected to the tabs to disengage the first lug from the first adapter or the second lug from the second adapter.

* * * * *